US007175393B2

(12) United States Patent
Chandraker

(10) Patent No.: US 7,175,393 B2
(45) Date of Patent: Feb. 13, 2007

(54) TRANSONIC BLADE PROFILES

(75) Inventor: Amrit Lal Chandraker, Hyderabad (IN)

(73) Assignee: Bharat Heavy Electricals Limited (IN)

( * ) Notice: Subject to any disclaimer, the term of this patent is extended or adjusted under 35 U.S.C. 154(b) by 25 days.

(21) Appl. No.: 10/861,603

(22) Filed: Jun. 4, 2004

(65) Prior Publication Data

US 2005/0220625 A1 Oct. 6, 2005

(30) Foreign Application Priority Data

Mar. 31, 2004 (IN) ..... 653/04

(51) Int. Cl.
*F01D 5/14* (2006.01)

(52) U.S. Cl. ..... 416/223 A; 416/DIG. 2; 416/DIG. 5

(58) Field of Classification Search ..... 416/243, 416/242, 238, 223 A, DIG. 2, DIG. 5
See application file for complete search history.

(56) References Cited

U.S. PATENT DOCUMENTS 2,415,847 A * 2/1947 Redding ..... 416/219 R
3,333,817 A * 8/1967 Rhomberg ..... 416/242
3,565,548 A * 2/1971 Fowler et al. ..... 416/223 R
4,695,228 A * 9/1987 Purcaru ..... 416/223 A
5,035,578 A * 7/1991 Tran ..... 416/223 A
5,192,190 A 3/1993 Ferleger et al.
5,211,703 A 5/1993 Ferleger et al.
5,779,443 A 7/1998 Haller et al.
6,709,239 B2 * 3/2004 Chandraker ..... 416/238
6,739,838 B1 * 5/2004 Bielek et al. ..... 416/223 A
6,802,695 B2 * 10/2004 Haller ..... 416/223 R

* cited by examiner

*Primary Examiner*—Edward K. Look
*Assistant Examiner*—Nathan Wiehe
(74) *Attorney, Agent, or Firm*—The Webb Law Firm

(57) ABSTRACT

The present invention relates to the aerodynamic design of moving blades, pertaining to later stages of axial steam turbines where the inlet flow is non-uniform over the blade height. The claim made herein is a set of six invented transonic blade profiles which can be used to develop various type of 3D twisted blades for axial steam turbine. The aerodynamic characteristics of these 6 base profiles are evaluated herein as a function of stagger angle and pitch/chord ratios.

5 Claims, 12 Drawing Sheets

Fig.1 PROFILE GEOMETRY DEFINITION
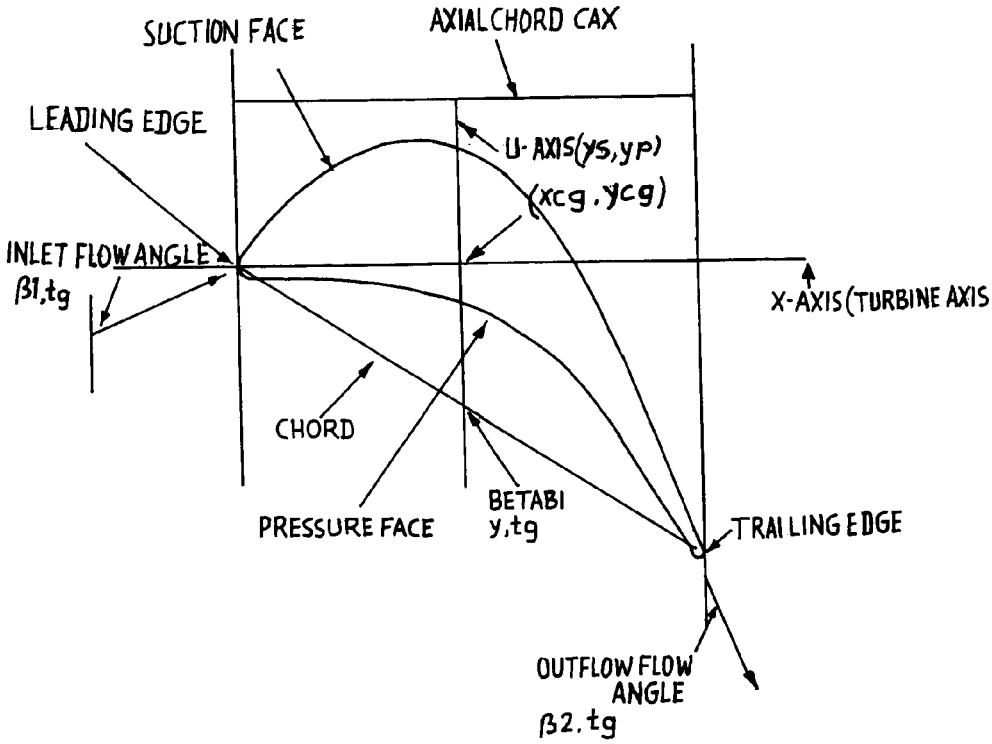
Fig. 2 STACKED PROFILES AND A CASCADE
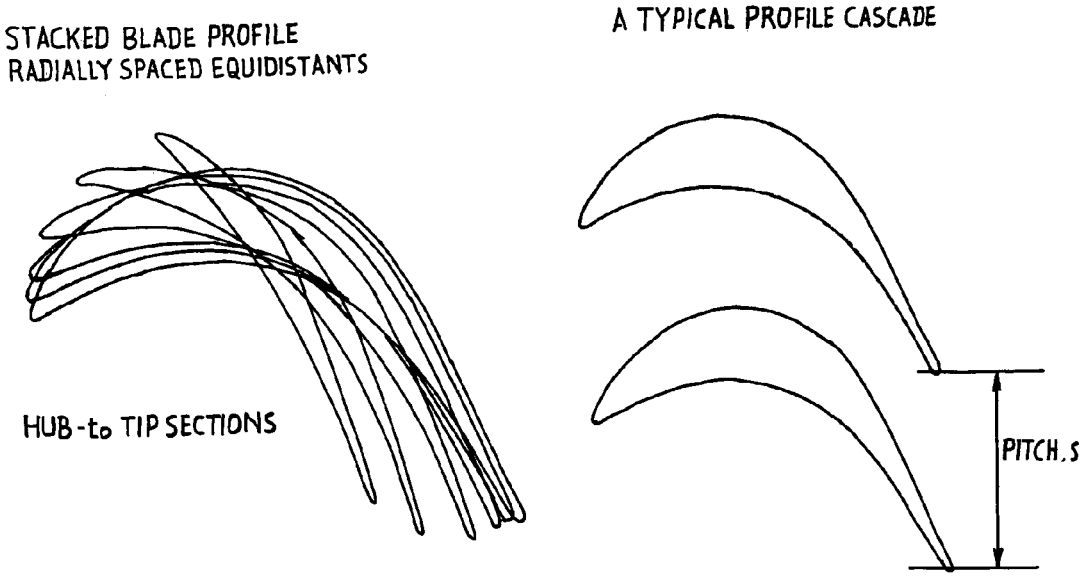

Fig. 2A. Base Profile : Typical Points
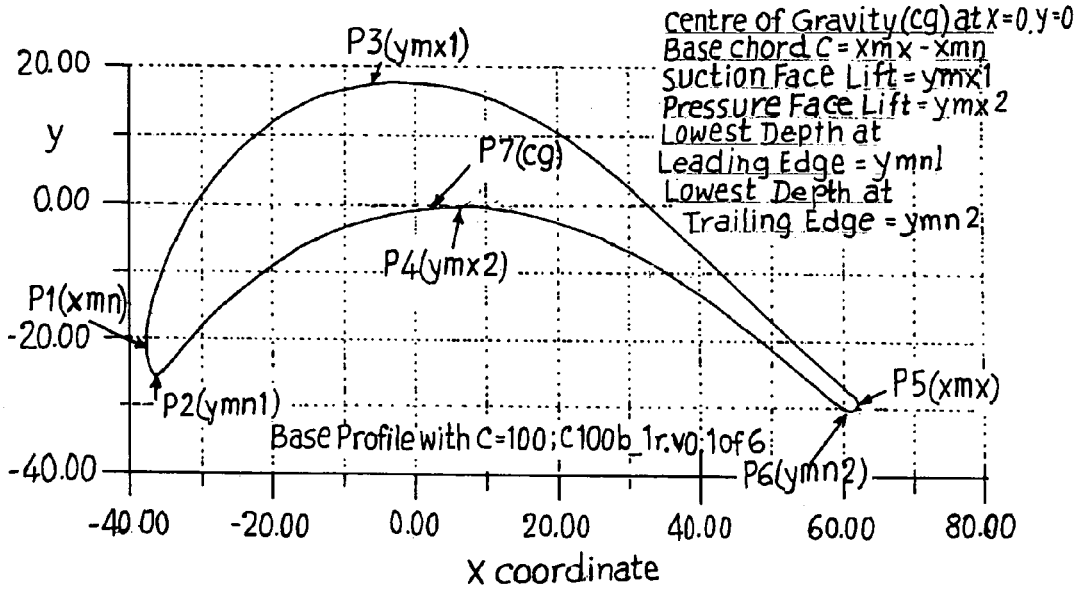
Fig 2B Base Profiles: Coordinates of Typical Points
| | Profile 1 | Profile 2 | Profile 3 | Profile 4 | Profile 5 | Profile 6 |
|---|---|---|---|---|---|---|
| Points | cordinates (x,y) | cordinates (x,y) | cordinates (x,y) | cordinates (x,y) | Cordinates (x,y) | cordinates (x,y) |
| P1 | -37.825 -22.10 | -38.497 -21.831 | -37.569 -22.020 | -37.741 -18.886 | -38.416 -15.143 | -39.250 -6.371 |
| P2 | -36.727 -25.93 | -37.414 -24.552 | -36.769 -23.777 | -37.042 -20.025 | -38.205 -15.518 | -38.771 -6.795 |
| P3 | -1.969 17.462 | -2.042 16.182 | 0.358 14.045 | -0.929 11.300 | -0.790 8.261 | -6.929 5.568 |
| P4 | 6.027 -0.430 | 5.059 1.195 | 5.704 2.007 | 6.225 1.614 | 3.952 0.875 | 4.076 -1.554 |
| P5 | 62.120 -28.937 | 61.397 -26.359 | 62.340 -24.720 | 62.097 -21.381 | 61.427 -16.011 | 60.551 -6.213 |
| P6 | 60.824 -30.530 | 60.324 -27.917 | 61.562 -25.929 | 61.599 -22.480 | 61.085 -16.937 | 60.213 -7.167 |

Fig. 3. Base Profiles : c100b_1r
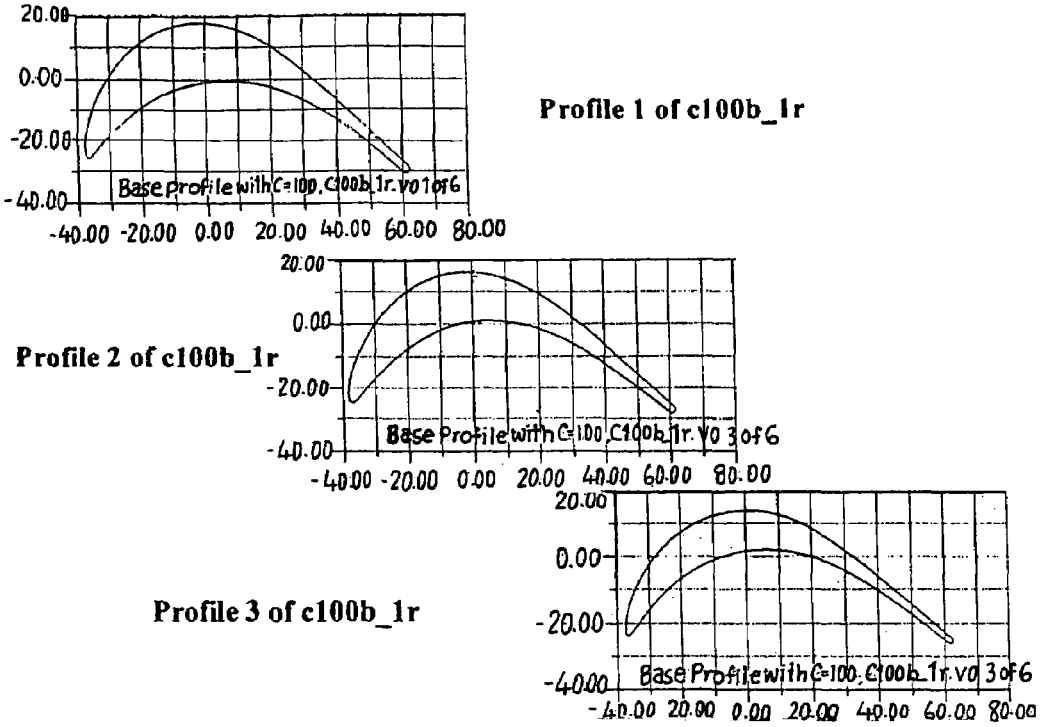
Fig. 4 Base Profiles : c100b_1r
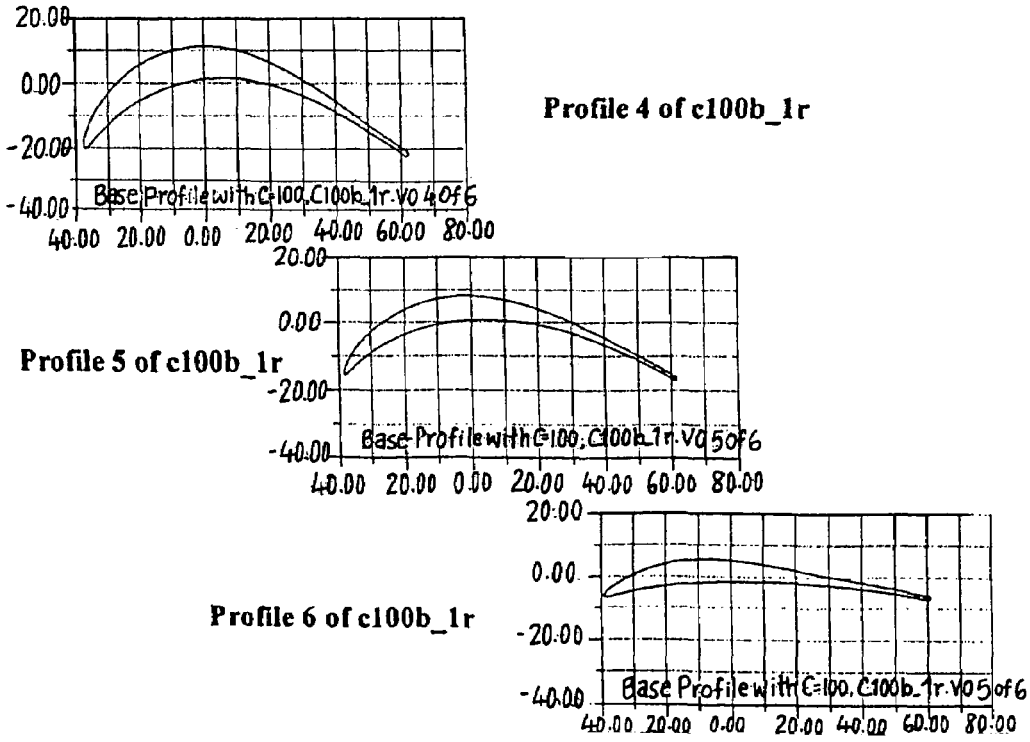

Fig. 5 3d View of a Typical Blade
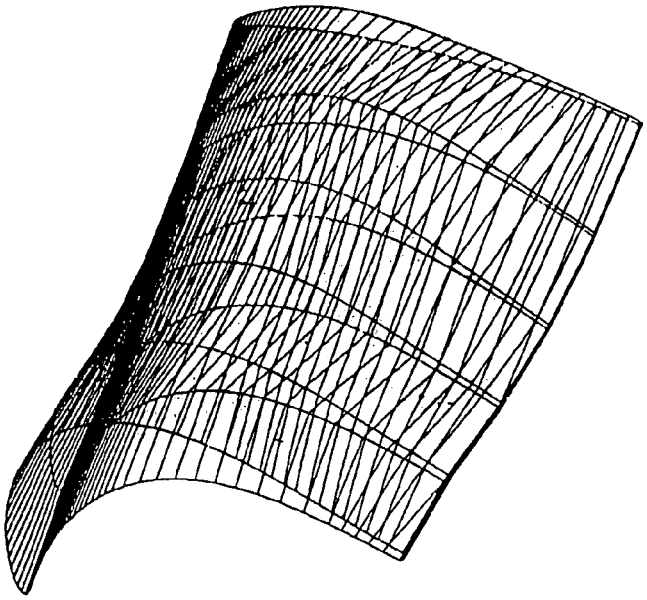
Fig. 6 Nomogram (beta2ax): Profile 1 of c100b_1r
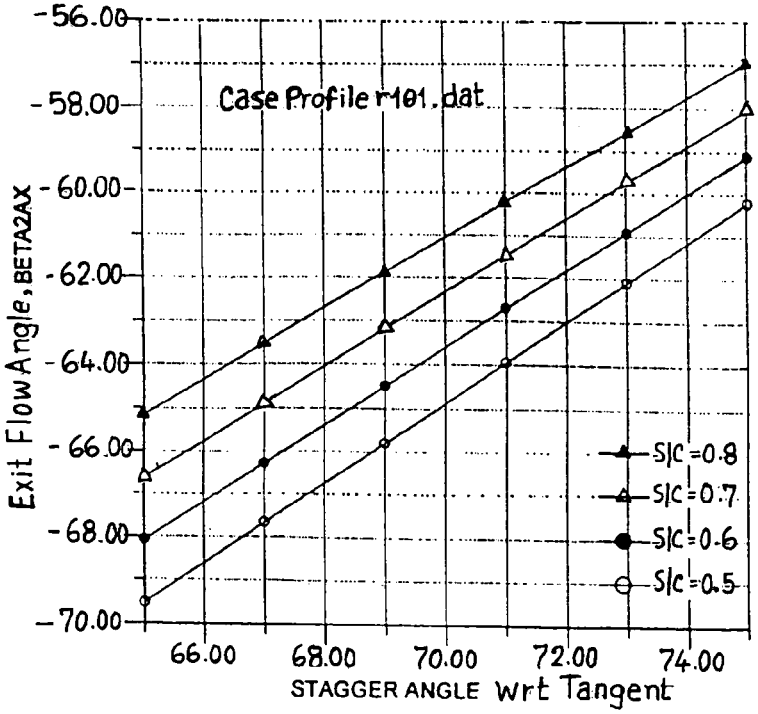

Fig. 7. Nomogram (zeta): Profile 1 of c100b_1r
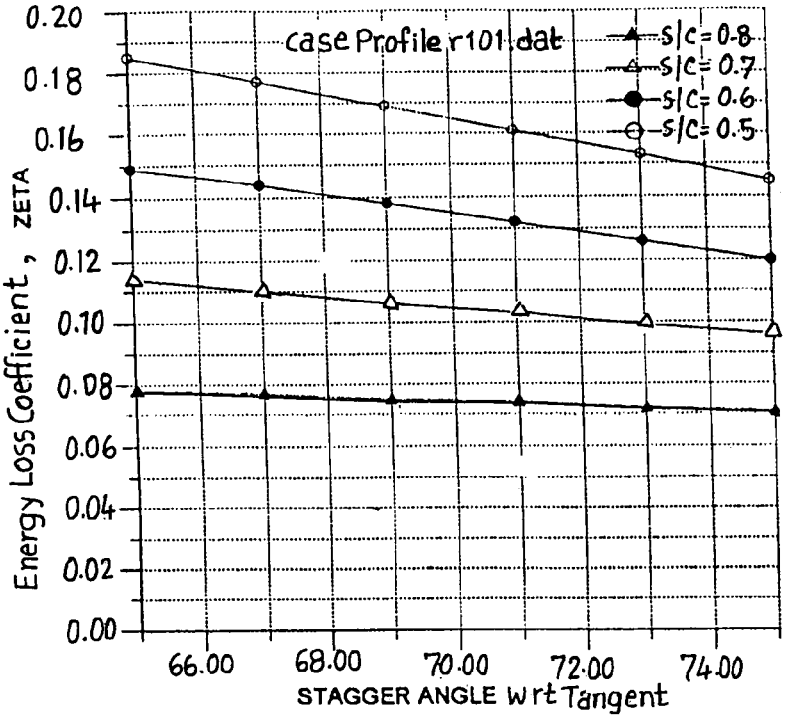
Fig. 8 Nomogram (beta2ax): Profile 2 of c100b_1r
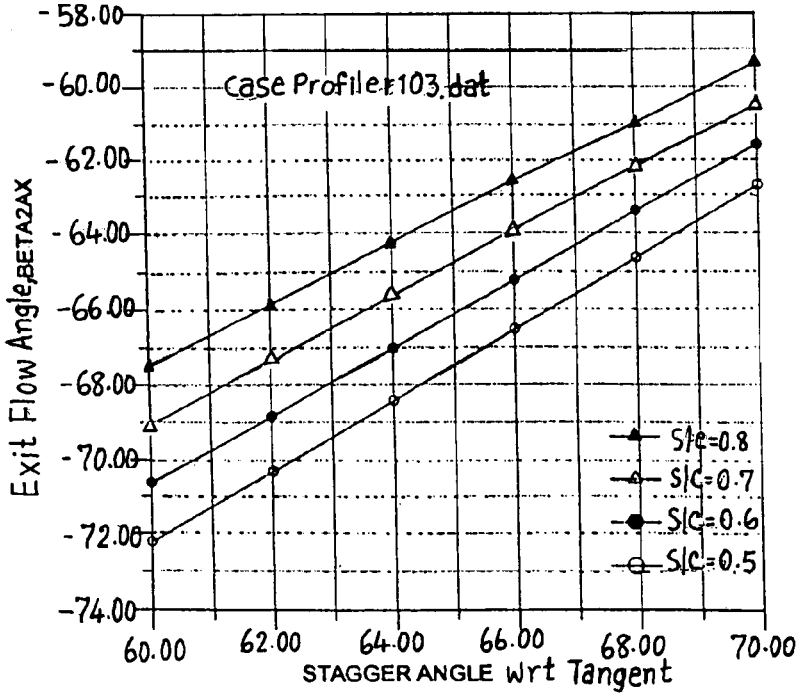

Fig.9 Nomogram (zeta): Profile 2 of c100b_1r
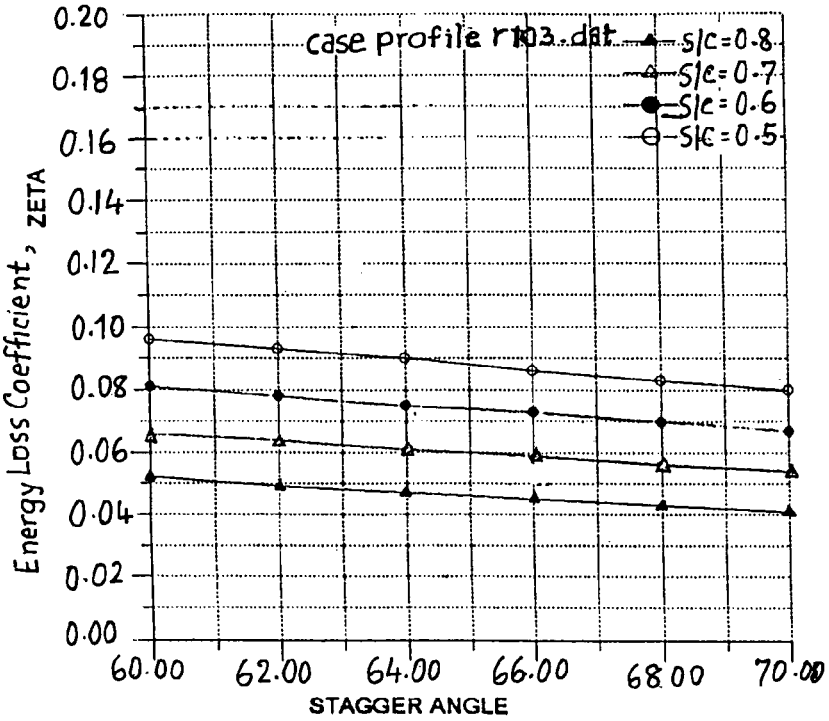
Fig.10 Nomogram (beta2ax): Profile 3 of c100b_1r
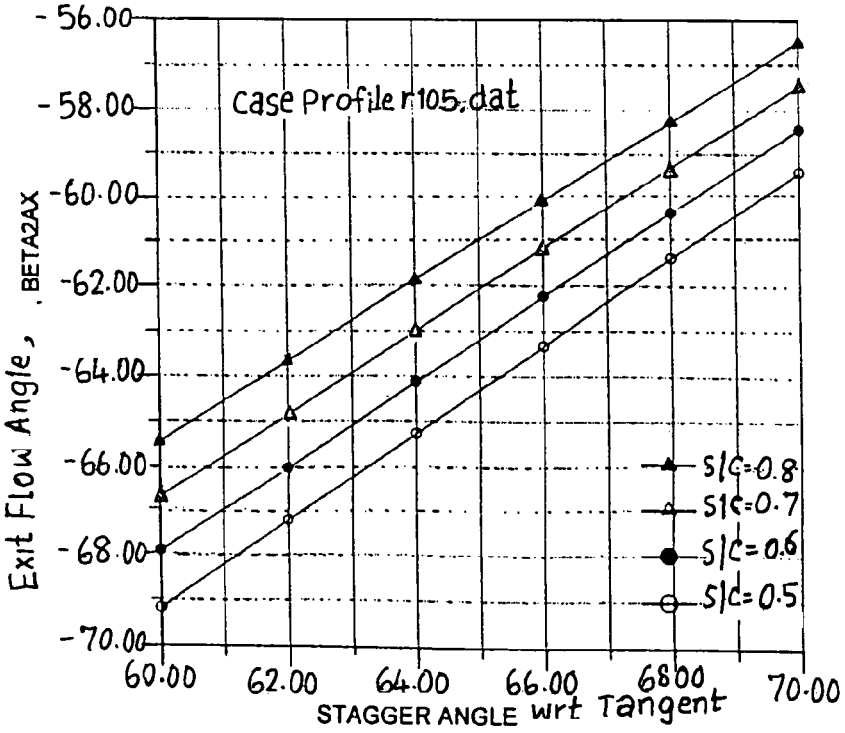

Fig 11 Nomogram (zeta): Profile 3 of c100b_1r
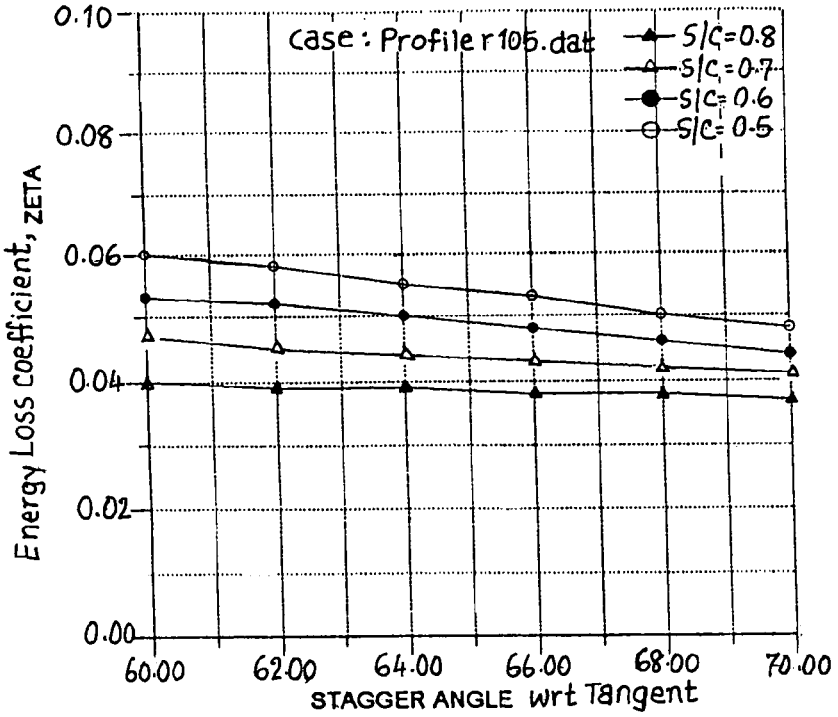
Fig. 12 Nomogram (beta2ax): Profile 4 of c100b_1r
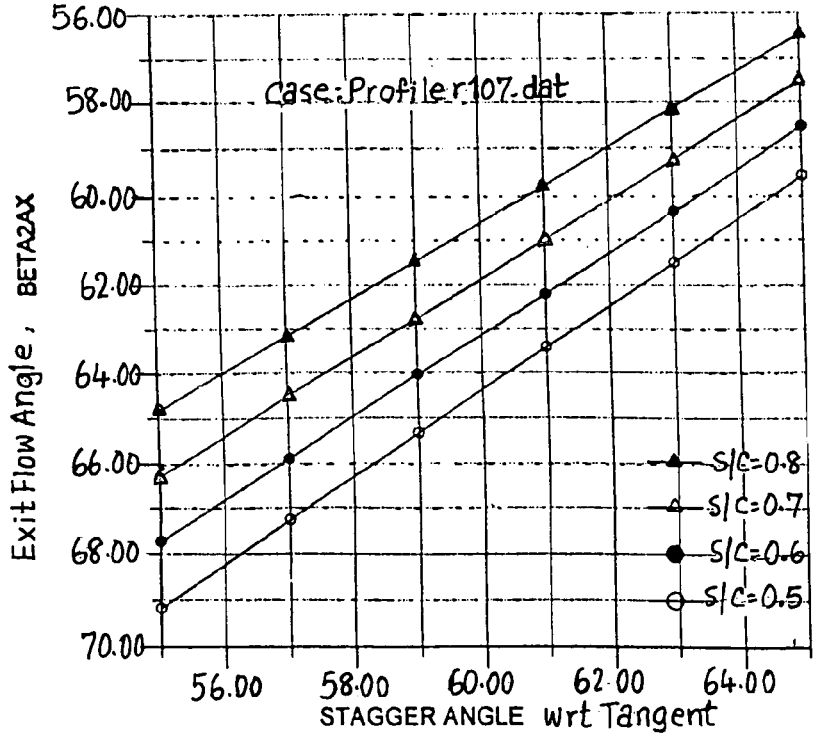

Fig.13 Nomogram (zeta): Profile 4 of c100b_1r
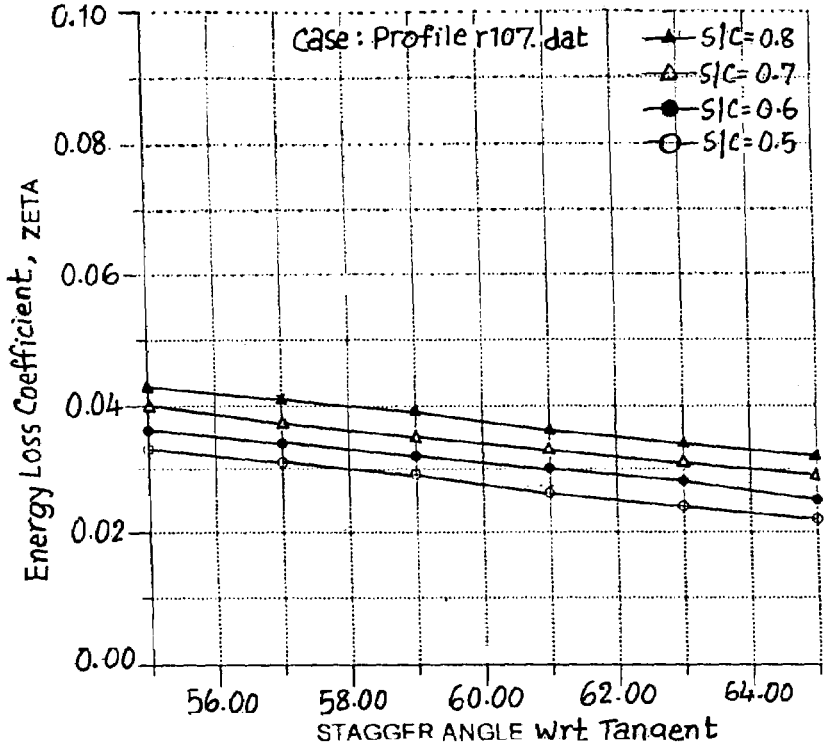
Fig.14 Nomogram (beta2ax): Profile 5 of c100b_1r
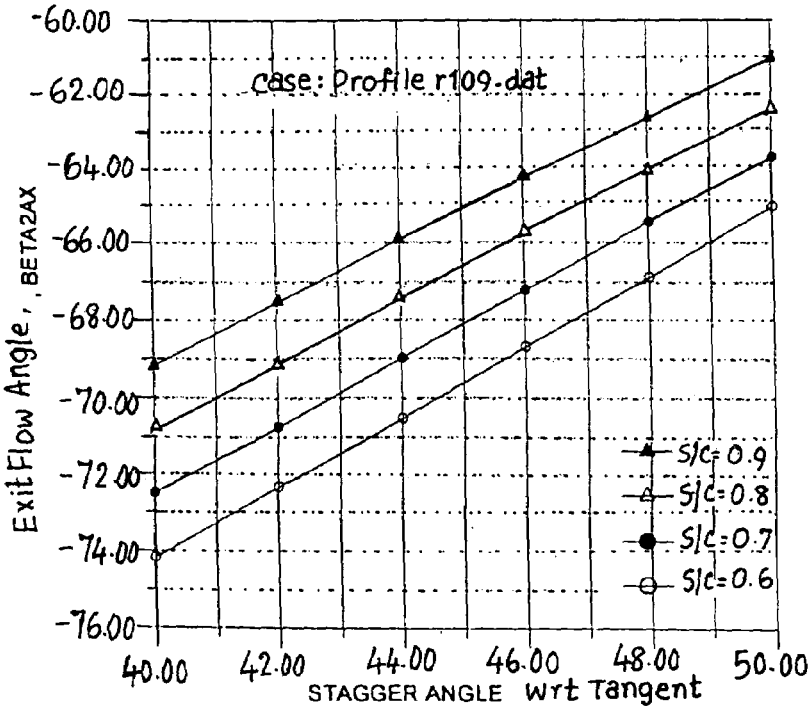

Fig. 15. Nomogram (zeta): Profile 5 of c100b_1r
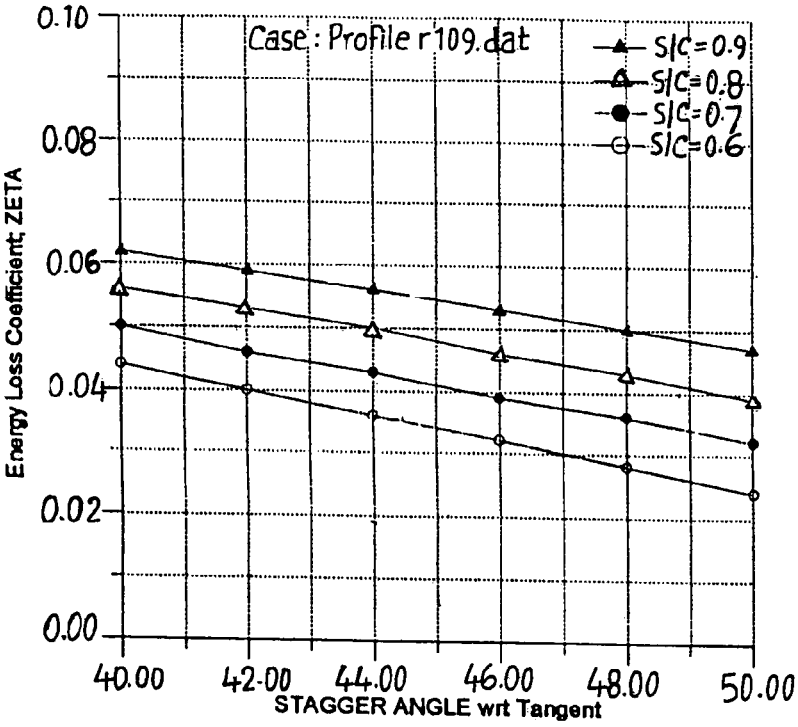
Fig. 16. Nomogram (beta2ax): Profile 6 of c100b_1r
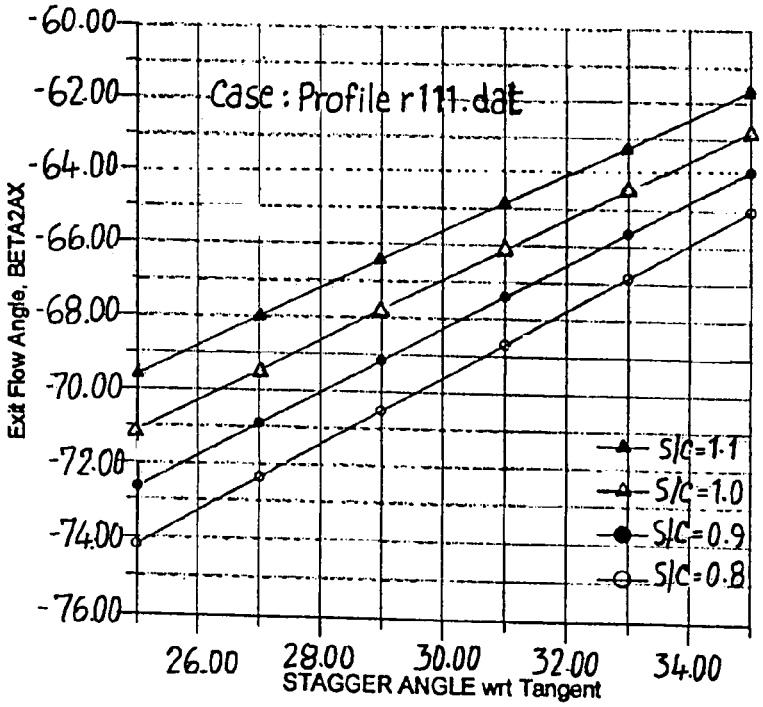

Fig. 17. Nomogram (zeta): Profile.6 of c100b_1r
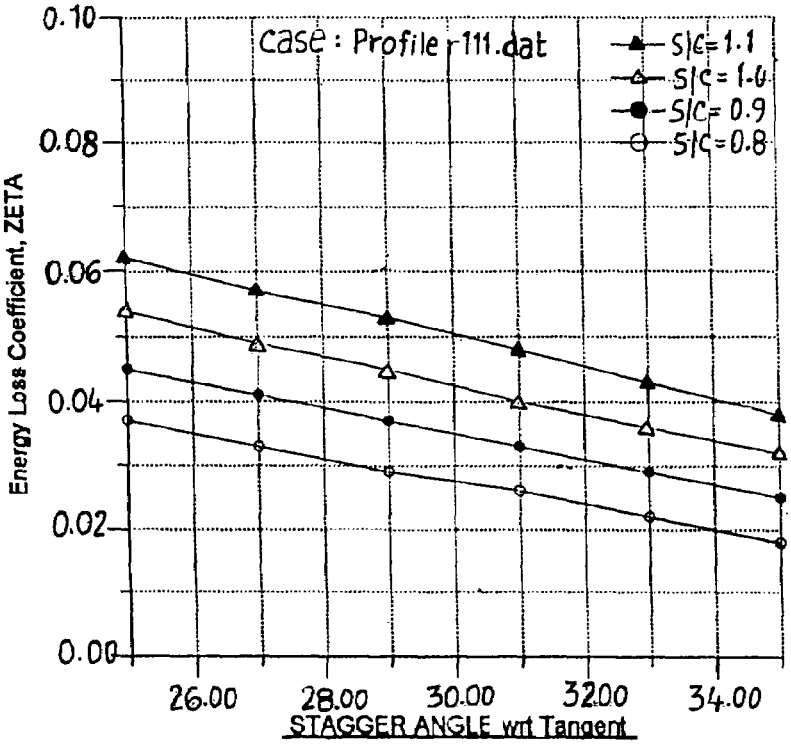
Fig. 18. Hub Profile : Grid & Iso-Mach Contours
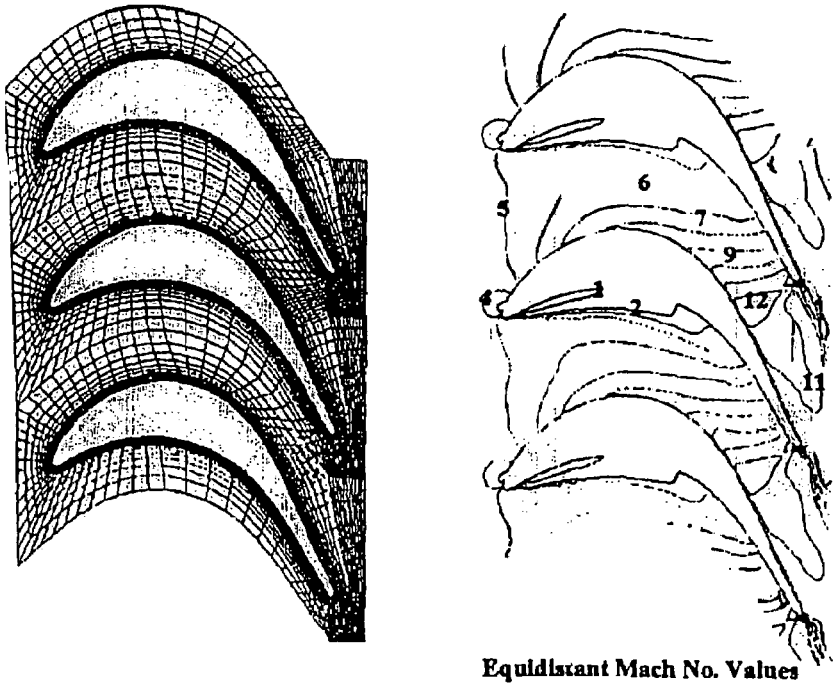
Equidistant Mach No. Values 1,2,..,11,12 refer to M=0.1..2...1.1.1.2

Fig 19. Tip Profile : Grid & Iso- Mach Contours
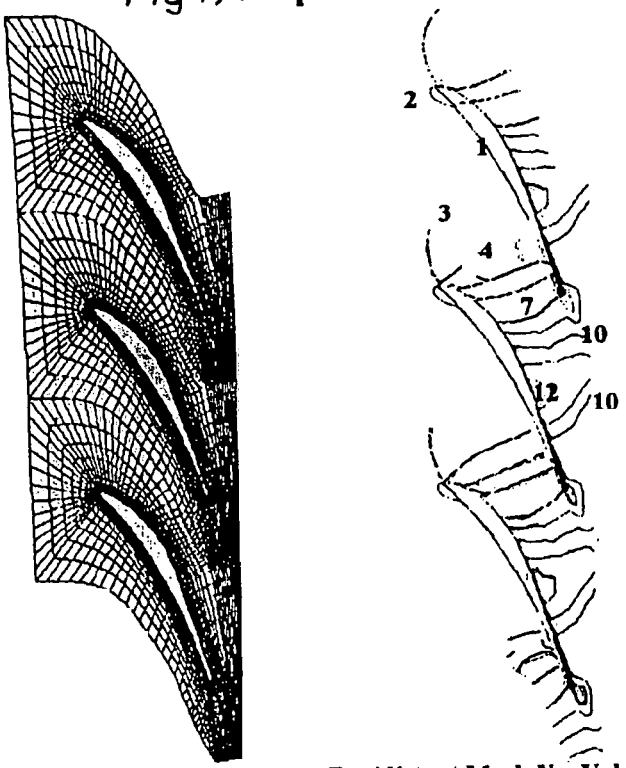
Equidistant Mach No. Values
1,2,..,11,12 refer to M=0.1,.2,..1.1,1.2
Fig. 20. Hub & Tip Profile : Surface Pressure Distribution
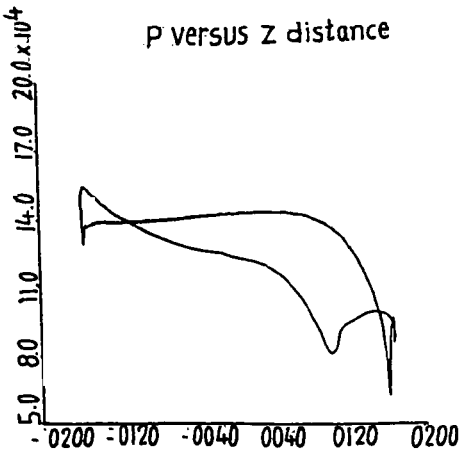
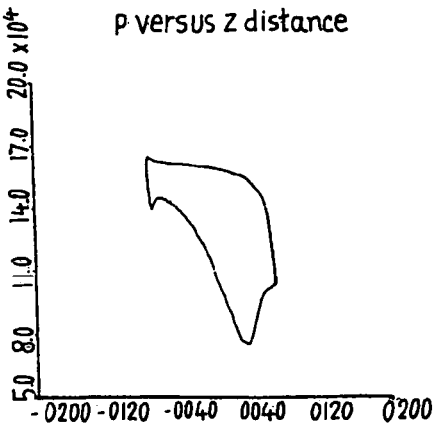

Fig. 21. Hub Profile : Surface Mach no. Distribution
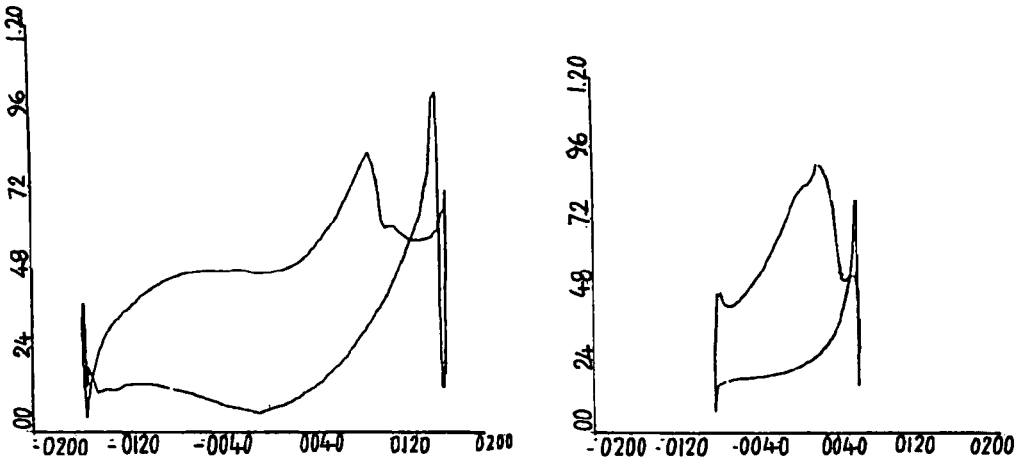
Fig. 22. Comparison of 2D CFD and 3D CFD Study
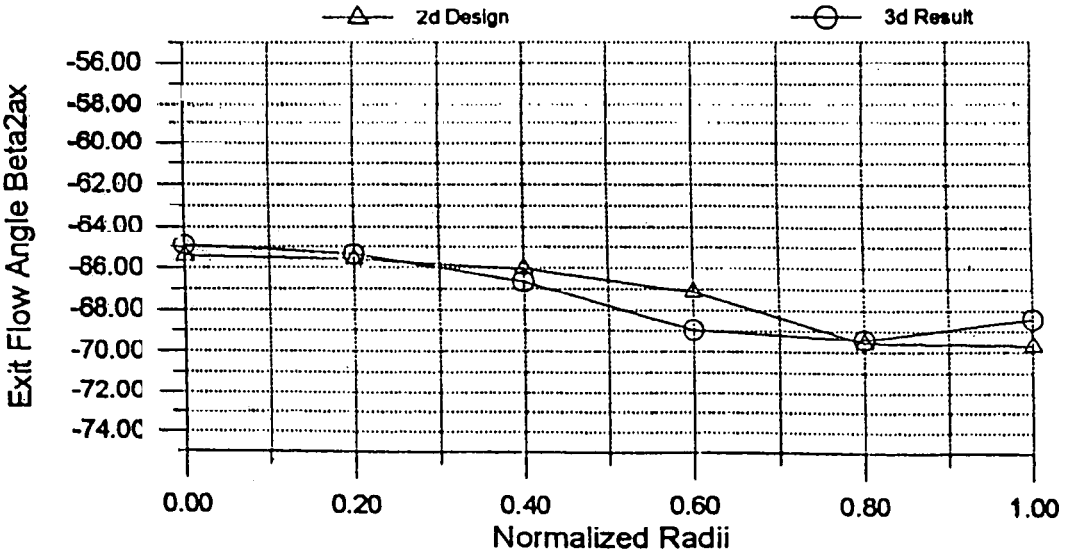

TRANSONIC BLADE PROFILES

FIELD OF INVENTION

This invention relates to transonic blade profiles for development of 3D twisted blades for axial steam turbine. The transonic flow is defined as one where the profile exit Mach number M (=flow speed/sound speed) lies within the range of 0.8–1.1.

BACKGROUND OF THE INVENTION

The design of 2D (referred as 2D or cylindrical blade having identical cross-section throughout the blade span) and 3D blades are of paramount importance for power generation. Various patents, e.g. U.S. Pat. No. 5,779,443 (1998), U.S. Pat. No. 5,211,703 (1993) and U.S. Pat. No. 5,192,190 (1993) refer to "stationary" blade. U.S. Pat. No. 5,779,443 deals with radially bent blade (radial shift of centers of areas of individual profiles over the blade height). The present invention refers to design of six base profiles and construction of moving blade (by making use of these base profiles) without radial shift for the use in steam turbine for power generation. The Redding patent (U.S. Pat. No. 2,415,847) refers to a set of six profiles for the compressor machine. It is not meant nor can be used for turbine applications.

In cylindrical stages, the profiles remain same for more than one stage over their blade height without significant loss in efficiency. The inlet flow is more or less uniform over the blade height. Usually a few profiles are sufficient to create many blade rows. The present invention primarily concerns to moving blade of axial steam turbines and the turbine stages, where the direction of incoming flow to moving blade varies along the blade height, thus necessitating twisted blade. Hence the design and manufacturing of twisted blade is costly and time consuming as it is to be done every time for varying flow condition.

Normally the conventional blades are of constant cross-section and cylindrical in shape over the blade height. At any cross section the shape of the profile remains same as shown typically in FIG. 1. The profile or section is made of two surfaces, suction face and pressure face, each joining leading edge to trailing edge. X-axis and y-axis coincide to turbine axis and circumferential direction, respectively.

The center of gravity lies at origin of coordinate axes. The blade or profile is set at angle 'betabi' or y,tg (or gamatg), also known as stagger angle with respect to U-axis. Chord is defined as axial distance of base profile measure between two farthest tangents to the profile; one at leading edge side and other at trailing edge side. The tangents are normal to the chord. Axial chord is the projected length of the profile on X-axis; hence varies with profile stagger. Inlet and exit flow angles β1,tg and β2,tg are fluid flow angles with respect to tangent (U-axis), respectively. The profile faces can be specified by various ways, e.g. through discrete points (x, y co-ordinates), through a set of arcs and through bezier points.

In this invention new 3D blade can be made of many such profiles (FIG. 1) but with varying shape and other parameters such as stagger angle, chord, axial chord, cross sectional areas (FIG. 2). The centers of gravity of the profiles coincide in x-y planes. The areas of cross section, stagger angles, and the ratio chord (c)/pitch (s) monotonously decrease from hub to tip, whereas pitch (=2Πr/no of blades; r=radius where the profile is located) increases along the blade height. A typical sketch of such set of stacked profiles for all six sections and blade-to-blade (cascade) view are. shown in FIG. 2.

OBJECTS OF THE INVENTION

An object of this invention is to propose steam turbine runner blades in tow and intermediate pressure cylinders are of higher height and higher aspect ratio compared to those of high pressure cylinders. They are needed to handle forger specific volume of steam during expansion; hence designer has to use twisted or 3D blades.

Another object of the present invention is to propose a set of six original transonic blade profiles, which can be used to develop various types of 3D blades for axial steam turbine.

DESCRIPTION OF INVENTION

According to this invention there is provided a set of six transonic blade profiles comprising each a pressure face and a suction face joined at their leading and trailing edges, the cross sections being twisted over the blade height and that the centers of gravity of these sections lie in a radial line.

BRIEF DESCRIPTION OF DRAWINGS

The nature of invention, its objective and further advantages residing in the same will be apparent from the following description made with reference to the non-limiting exemplary embodiments of the invention represented in the accompanying drawings.

FIG. 1. Profile Geometry Definition
FIG. 2. Stacked Profiles and a Cascade
FIG. 2A. Base Profile: Typical Points
FIG. 2B. Base Profile: Coordinates of Typical Points
FIG. 3. Base Profiles: c100b_1r
FIG. 4. Base Profiles: c100b_1r
FIG. 5. 3D View of a Typical Blade
FIG. 6. Nomogram (beta2ax): Profile 1 of c100b_1r
FIG. 7. Nomogram (zeta): Profile 1 of c100b_1r
FIG. 8. Nomogram (beta2ax): Profile 2 of c100b_1r
FIG. 9. Nomogram (zeta): Profile 2 of c100b_1r
FIG. 10. Nomogram (beta2ax): Profile 3 of c100b_1r
FIG. 11. Nomogram (zeta): Profile 3 of c100b_1r
FIG. 12. Nomogram (beta2ax): Profile 4 of c100b_1r
FIG. 13. Nomogram (zeta): Profile 4 of c100b_1r
FIG. 14. Nomogram (beta2ax): Profile 5 of c100b_1r
FIG. 15. Nomogram (zeta): Profile 5 of c100b_r
FIG. 16. Nomogram (betaZax): Profile 6 of c100b_1r
FIG. 17. Nomogram (zeta): Profile 6 of c100b_1r
FIG. 18. Hub Profile: Grid & Iso-Mach Contours
FIG. 19. Hub Profile: Grid & Iso-Mach Contours
FIG. 20. Hub & Tip Profile: Surface Pressure Distribution
FIG. 21. Hub Profile: Surface Mach no Distribution
FIG. 22. Comparison of 2D CFD and 3D CFD Study

GEOMETRY AND FLOW FEATURES

Usually the flow in low pressure cylinder and 3D moving blade used for the steam expansion through the cylinder have the following common features 1. Inlet flow angle β1,tg at hub is more acute than that at tip side.
2. Exit Mach number (Mach number M=:flow velocity/sound speed) at hub is lower than that at the tip.
3. Maximum centrifugal stress is at hub, hence larger area of hub profile.

4. Higher solidity at hub for mechanical strength, hence the blade profile at hub has lower pitch/chord ratio compared to profiles at the tip side.
5. Exit flow is transonic.
6. Hub profile is more cambered than tip profile to account flow turning.
7. Blade is usually tapered to maintain nearly equal gap between upstream and downstream blade rows; from hub to tip.
8. Exit flow angle β2, tg at tip is more acute than that at the hub side.

Invented Base Profiles: The invented base profiles are Bezier generated ones and typically described by typical points (FIG. 2A).

Point P1=the location of minimum x-coordinate (xmn).

Point P2=the location of minimum y-coordinate. At leading edge side (ymn 1).

Point P3=the location of maximum y-coordinate (ymx1).

Point P4=the location of maximum y-coordinate (ymx2).

Point P5=the location of maximum x-coordinate (xmx).

Point P6=the location of minimum y-coordinate. At trailing edge side (ymn2).

Point P7 the location of center of gravity, x=0, y=0.0.

Base chord=xmx−xmn=100.0 units of length (reference).

The data file containing a series of 6 base profiles (FIGS. 3 and 4) is designed as c100_1r. The file consists of 6 sets of profile each with 91 points on each of the two surfaces: suction and pressure surfaces. The file c100_1r contains first the profile with highest camber followed by profile with lower camber.

Each of the base profiles has base chord length as 100 units. The coordinates can be scaled up or down as per the need. The center of all profile area lies at point (0.0, 0.0). The percentage ratio of maximum blade thickness to base chord varies approximately 18.3, 15.5, 12.8, 10.2, 7.9 and 7.7 from first to last profiles. The unique geometrical feature of each base profile is that the trailing edge is below the base line. FIG. 2B provides the coordinates of 6 typical points of each of the 6 profiles.

A typical view of 3D blade using base profile of c100_1r for a sample set of stagger angle and chord is shown in FIG. 5.

Analysis based on two-dimensional (2D) Computational Fluid Dynamics (CFD): The initial setting angle for this base profile is y.tg=90.0 deg. Each of the 6 base profiles staggered to values desired for 3D blade formation is analyzed for a set of pitch/chord ratio transonic Mach no. M2=0.9. The aerodynamic performance is computed by a 2D CFD (Computational Fluid Dynamic) solver and database is created in the form of aerodynamic characteristics (nomograms). Nomogram is a graphic representation of numerical relations.

Cascade performance of individual profiles is simulated by a CFD solver using air as fluid medium with the ratio of specific heats k=1.4.

Energy loss coefficient zeta or ζ defined as $$\varsigma = 1 - \left[1 - (p2/po2)^{\frac{k-1}{k}}\right] \Big/ \left[1 - (p2/po2)^{\frac{k-1}{k}}\right]$$

where p2 is mass-averaged static pressure at the outlet; po1 and po2 are mass averaged stagnation pressure at the inlet and exit of the cascade.

Outlet flow angle (beta2ax) is computed as function of pitch/chord ratio and stragger angle (gamatg): Similarly energy loss coefficient (zeta) is found as function of pitch/chord ratio and stragger angle (gamatg). Note: Beta2ax=β2, tg−90.0; Beta1ax=90−β1,tg degree.

FIGS. 6 to 17 are the invented aerodynamic characteristics (nomograms) for 6 base profiles listed as c100_1r. The variants are as follows:

Profile 1: s/c=0.5–0.8; gamatg=65–75 deg; beta1ax=30; M2=0.9

Profile 2: s/c=0.5–0.8; gamatg=60–70 deg; beta1ax=30; M2=0.9

Profile 3: s/c=0.5–0.8; gamatg=60–70 deg; beta1ax=30; M2=0.9

Profile 4: s/c=0.5–0.8; gamatg=55–65 deg; beta1ax=30; M2=0.9

Profile 5: s/c=0.6–0.9; gamatg=40–50 deg; beta1ax=10; M2=0.9

Profile 6: s/c=0.8–1.1; gamatg=25–35 deg; beta1ax=10; M2=0.9

The effects of M2 is limited if M2=0.8–1.1; and effect of beta1x is also limited variation is about 10 degrees on either side of above quoted values. These results (nomograms) are useful for first level design, which can be improved by 3D CFD study.

Some general inferences from the nomograms are to be noted:

1. As gamatg increases, zeta decreases at fixed pitch/chord ratio s/c
2. As gamatg increases, beta2ax increases at fixed pitch/chord ratio s/c.
3. As s/c ratio increases, beta2ax increases at fixed gamatg.
4. As s/c ratio increases, zeta decreases at fixed gamatg for profiles 1, 2, 3.
5. As s/c ratio increases, zeta increases at fixed gamatg for profiles 4, 5, 6.
6. Higher the profile camber, higher the loss; hence profile 1 has high zeta.

3D-Blade Design: A number of 3D blade shape can be designed knowing profile-wise stagger, which gives the desired outlet angle and loss; and also making use of profile-wise scaling factor to suit blade taper from hub to tip to suit steam flow path design. The profile rotation (stagger) as well as scaling is done with respect to center of area (center of gravity; e.g) of each profile. Scaling implies profile blow up and blow down keeping e.g. same; thus scale factor in x and U (or y) directions of the profile.

A computer program "blade3d" developed by the inventor performs the above job; i.e. stacking about e.g. and sealing of profile, just by specifying the file name containing profiles i.e. c100b_1r; gamatg and scale factor profile-wise; as well as radius of profile section in blade height. FIG. 5 shows a 3D blade for gaining for gamatg=70, 65, 60, 55, 50, 45 for hub to tip profile at radii=500, 520, 540, 560, 580, 600 mm and scaling factor as 0.5 common for all 6 profile with a set of base profile designated by the data file name c100b_1r.

Analysis based on three-dimensional (3D) Computational Fluid Dynamics (CFD); It may be noted above that profile-wise orientation is made using nomograms based on 2D CFD analysis Geometrical shape of a 3D blade is made by logic discussed in earlier section or by using computer software "blade3d". Thus, the first level of design for a 3D blade is ready which needs to be tested and refined if necessary, by making use of 3D CFD software or experiment.

A typical 3D blade for a typical flow condition resembling low pressure power turbine first STAGE IS constructed with gamatg=69, 66, 55, 53, 29, AND SCALE=0.353, 0.353, 0.352, 0.352, 0.335, 0.290 for profile 1 to 6 respectively. The above stagger angles and nomograms for s/c amounting to no of blade z=67 for radii=200, 213, 226, 239, 252, 265; gave the outlet angles as needed by a typical existing steam flow path design.

Three dimensional flow analysis by a CFD solver was carried out for this moving blade row. FIGS. 18 and 19 show the grid and Iso-Mach contours for typically two profile: hub and tip. Surface pressure distribution and Mach number distribution with respect to axial flow direction; say z, are shown in FIGS. 20 and 21. A suction peak midway between the middle and of the suction surface is visible. The profiles appear to be aft-loaded. The comparison of outlet flow angles as computed by 2D CFD and 3D CFD is shown in FIG. 22. The comparison is satisfactory.

I claim:

1. A set of six transonic blade profiles comprising each a pressure face and a suction face joined at their leading and trailing edges, the cross sections being twisted over the blade height and that the centers of gravity of these sections lie in a radial line, the profile pitching and setting are as follows:

Profile 1: s/c=0.5–0.8, gamatg=65–75 deg;
Profile 2: s/c=0.5–0.8, gamatg=60–70 deg;
Profile 3: s/c=0.5–0.8, gamatg=60–70 deg;
Profile 4: s/c=0.5–0.8, gamatg=55–65 deg;
Profile 5: s/c=0.6–0.9, gamatg=40–50 deg; and
Profile 6: s/c=0.8–1.1, gamatg=25–35 deg, wherein gamatg is the stagger angle and s/c is the pitch to chord ratio wherein outlet flow Mach number is 0.8–1.1, and wherein the blade profiles are equally spaced over the blade height and Profile 1 is at a hub or root (zero height), Profile 6 is at a tip and the remaining Profiles 2, 3, 4, and 5 are at intermediate heights of the blade.

2. Transonic blade profiles as claimed in claim 1 wherein base profiles are Bezier generated and typically described by typical points:

Point P1=the location of minimum x-coordinate (xmn);
Point P2=the location of minimum y-coordinate at leading edge side (ymn1);
Point P3=the location of maximum y-coordinate on suction face (ymx1);
Point P4=the location of maximum y-coordinate on pressure face (ymx2);
Point P5=the location of maximum x-coordinate (xmx);
Point P6=the location of minimum y-coordinate at trailing edge side (ymn2);
Point P7=the location of center of gravity, x=0.0, y=0.0; and
Base chord=xmx−xmn=100 (reference), wherein the Profiles are provided at a different height of the blades, equi-spaced over the blade, and two coordinates, x and y, for each Profile is given by the Profile orientation and the third coordinate is defined by the value of height from the hub or root.

3. A set of six transonic blade profiles as claimed in claim 1 wherein the coordinates of typical points of base profiles are (with reference to xmx−xmn=100 units of linear dimension):

Profile 1:
P1: x=−37.825, y=−22.10;
P2: x=−36.727, y=−25.93;
P3: x=−1.969, y=17.462;
P4: x=6.027, y=−0.430;
P5: x=62.120, y=−28.937; and
P6: x=60.824, y=−30.530;

Profile 2:
P1: x=−38.497, y=−21.83;
P2: x=−37.414, y=−24.55;
P3: x=−2.042, y=16.182;
P4: x=5.059, y=1.195;
P5: x=61.397, y=−26.359; and
P6: x=60.324, y=−27.917;

Profile 3:
P1: x=−37.569, y=−22.02;
P2: x=−36.769, y=−23.777;
P3: x=0.358, y=14.945;
P4: x=5.704, y=2.007;
P5: x=62.340, y=−24.720; and
P6: x=61.562, y=−25.929;

Profile 4:
P1: x=−37.741, y=−18.888;
P2: x=−37.042, y=−20.025;
P3: x=−0.929, y=11.300;
P4: x=6.225, y=1.614;
P5: x=62.097, y=−21.381; and
P6: x=61.599, y=−22.480;

Profile 5:
P1: x=−38.416, y=−15.14;
P2: x=−38.205, y=−15.51;
P3: x=−0.790, y=8.261;
P4: x=3.952, y=0.875;
P5: x=61.427, y=−16.011; and
P6: x=61.085, y=−16.937;

and

Profile 6:
P1: x=−38.250, y=−6.371;
P2: x=−38.771, y=−6.795;
P3: x=−6.929, y=5.568;
P4: x=4.076, y=−1.554;
P5: x=60.551, y=−6.213; and
P6: x=60.213, y=−7.167.

4. A set of six transonic blade profiles as claimed in claim 1 wherein the centers of gravity of the profiles coincide in x-y planes, wherein the loci of centers of gravity of the blade profiles when formed as a blade is a straight line.

5. A set of six transonic blade profiles as claimed in claim 1 wherein the areas of cross section, stagger angles, and the ratio chord (c)/pitch (s) decrease from hub to tip, whereas pitch (=2Πr/no of blades; Π=3.14159; r=radius where the profile is located) increases along the blade height.

* * * * *

UNITED STATES PATENT AND TRADEMARK OFFICE

CERTIFICATE OF CORRECTION

PATENT NO. : 7,175,393 B2
APPLICATION NO. : 10/861603
DATED : February 13, 2007
INVENTOR(S) : Chandraker It is certified that error appears in the above-identified patent and that said Letters Patent is hereby corrected as shown below:

Column 3, Line 58, the following formula:

$$\zeta = 1 - [1 - (p2/po2)^{\frac{k-1}{k}}]/[1 - (p2/po2)^{\frac{k-1}{k}}]$$

should read:

$$\zeta = 1 - [1 - (p2/po2)^{\frac{k-1}{k}}]/[1 - (p2/po1)^{\frac{k-1}{k}}]$$

Signed and Sealed this

Nineteenth Day of June, 2007

JON W. DUDAS
*Director of the United States Patent and Trademark Office*